US008246811B2

(12) United States Patent
Debuisschert et al.

(10) Patent No.: US 8,246,811 B2
(45) Date of Patent: Aug. 21, 2012

(54) PROCESS FOR THE PRODUCTION OF A HYDROCARBON FRACTION WITH A HIGH OCTANE NUMBER AND A LOW SULFUR CONTENT

(75) Inventors: Quentin Debuisschert, Rueil Malmaison (FR); Jacinthe Frecon, Rueil Malmaison (FR); Robert L. Huggins, Erwing (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 423 days.

(21) Appl. No.: 12/471,736

(22) Filed: May 26, 2009

(65) Prior Publication Data

US 2010/0300932 A1 Dec. 2, 2010

(51) Int. Cl.
*C10G 69/04* (2006.01)

(52) U.S. Cl. ..... 208/212; 208/53; 208/57; 208/58; 208/208 R; 208/209; 208/211; 208/216 R; 208/217; 208/311; 208/313; 208/339

(58) Field of Classification Search ..... 208/53, 208/57, 208 R, 209, 211–212, 216 R, 217, 208/311, 313, 339
See application file for complete search history.

(56) References Cited

U.S. PATENT DOCUMENTS

| | | | | |
|---|---|---|---|---|
| 5,582,714 | A * | 12/1996 | Forte | 208/237 |
| 6,551,502 | B1 * | 4/2003 | Lee et al. | 208/211 |
| 7,374,667 | B2 | 5/2008 | Debuisschert et al. | |
| 2005/0150819 | A1 * | 7/2005 | Wachs | 208/208 R |

FOREIGN PATENT DOCUMENTS

| | | | |
|---|---|---|---|
| WO | WO 02/072738 A1 | | 9/2002 |
| WO | WO 2006/063201 | * | 6/2006 |

OTHER PUBLICATIONS

Stoodt, T.J. et al. (2003). Handbook of Petroleum Refining Processes, 3rd ed., McGraw-Hill, 900 pgs.*

* cited by examiner

*Primary Examiner* — Walter D Griffin
*Assistant Examiner* — Brian McCaig
(74) *Attorney, Agent, or Firm* — Millen, White, Zeland & Branigan, P.C.

(57) ABSTRACT

Process for the production of a hydrocarbon fraction with a high octane number and a low sulfur content from a hydrocarbon feedstock, comprising at least the following stages:

Figure 1:
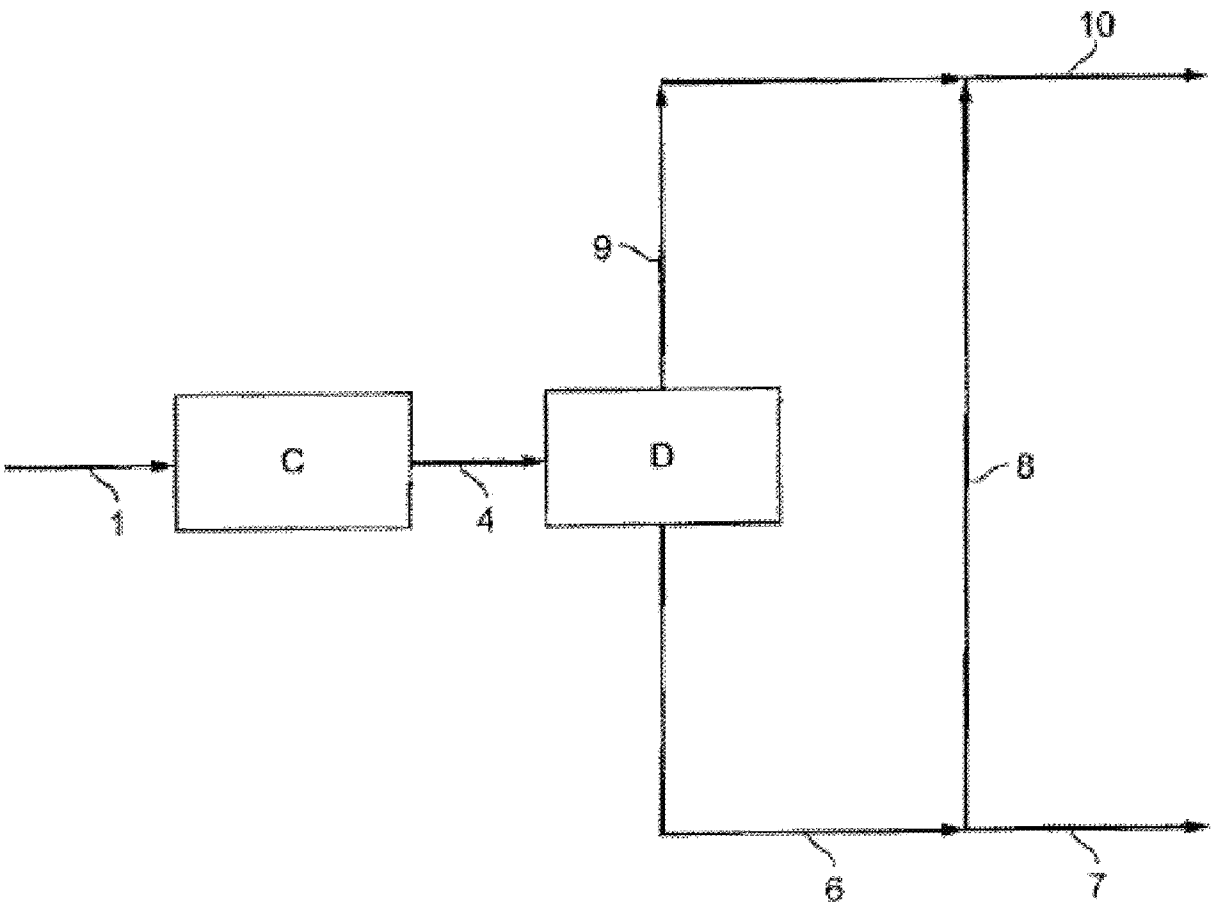

1) a hydrodesulfurization stage of the hydrocarbon feedstock, and 2) at least one stage for extracting aromatic compounds on all or part of the effluent that is obtained from the hydrodesulfurization stage, whereby said extraction leads to a paraffin-enriched raffinate and an aromatic compound-enriched extract sent to a gasoline pool to improve its octane number, wherein a portion of the paraffinic raffinate can be used in a mixture with the aromatic extract; another portion can be used as a petrochemistry base either for producing aromatic compounds or for producing olefins.

34 Claims, 3 Drawing Sheets

PROCESS FOR THE PRODUCTION OF A HYDROCARBON FRACTION WITH A HIGH OCTANE NUMBER AND A LOW SULFUR CONTENT

This invention relates to the field of the improvement in the octane number of a hydrocarbon fraction, and more particularly a process for the production of a hydrocarbon fraction with a high octane number and a low sulfur content, which makes it possible to upgrade the entire fraction, to reduce the total sulfur contents of the fraction to very low levels, while increasing the octane number of the fraction.

The petroleum refining as well as the petrochemistry are now subjected to new constraints. Actually, all of the countries are gradually adopting strict sulfur specifications: the objective is to reach between 5 to 10 ppm of sulfur. The problem of reducing sulfur contents is concentrated essentially on the gasolines that are obtained by cracking, whether it be catalytic (FCC: Fluid Catalytic Cracking according to English terminology) or non-catalytic (coking, visbreaking, steam-cracking), primary sulfur precursors in the gasoline pools. Today, there are schemes for bringing the gasoline of catalytic cracking into compliance with the sulfur specifications. Although these schemes attempt to limit the loss of olefins, they inevitably involve an octane loss regardless of the technology that is used, which poses a problem at a time where the octane constraints imposed by the automobile manufacturers are increasingly strong.

A second constraint arises because the fuel market produces a continuous reduction of the demand for gasoline in favor of diesel while maintaining a high quality requirement of the gasoline on the octane plane, the Reid vapor pressure, and the sulfur content. It is therefore important to produce gasoline of improved quality but in a reduced quantity in favor of the distillates (kerosene and diesel).

A third constraint arises from petrochemistry and in particular from the processes of steam-cracking and catalytic reforming that—for producing respectively olefins and aromatic compounds having the highest value (ethylene and propylene)—sees the price of its raw materials (the naphthas in particular) increase alarmingly and sustainably because of the limitations of resources to come and requires feedstocks that are low in aromatic compounds.

One solution, well known to one skilled in the art, for reducing the sulfur content, consists in carrying out a hydrotreatment (or hydrodesulfurization) of the hydrocarbon fractions and in particular catalytic cracking gasolines. However, this process offers the major drawback of bringing about a very significant drop in the octane number.

Other processes for desulfurizing the olefinic gasolines by limiting the hydrogenation of the olefins, and consequently by minimizing the reduction of the octane number, are described in numerous patents.

The patent EP1370627, for example, exhibits a process for the production of gasoline with a low sulfur content, comprising at least one selective hydrogenation of the diolefins that are present in the initial gasoline, a stage for transformation of the light sulfur compounds that are present in the gasoline, a fractionation of the gasoline that is obtained in at least two fractions, a light fraction and a heavy fraction, and a desulfurization treatment in a stage of at least a portion of the heavy fraction that is obtained from fractionation. This process thus makes it possible to reduce the amount of sulfur that is present in the gasoline and to obtain gasolines whose octane number is better than the one that could be obtained with simply one hydrotreatment. However, even if the octane number is improved, relative to the one that is obtained with a hydrotreatment, it is ultimately degraded, i.e., less than that of the treated feedstock.

This invention therefore has as its object to eliminate one or more of the drawbacks of the prior art by proposing a process for production of a hydrocarbon fraction, starting from a hydrocarbon feedstock and, for example, a catalytic cracking gasoline fraction, making it possible to meet the above-mentioned constraints:

- Bringing the hydrocarbon feedstock into compliance with the sulfur specifications with a product octane number that is greater than or equal to that of the feedstock and a substantial reduction of the olefin content.
- Conversion of a portion of the hydrocarbon feedstock into a base for petrochemistry.
- And in some cases, conversion of a portion of the hydrocarbon feedstock into middle distillates with a low sulfur content.
- Sending only a portion of the original gasoline to a gasoline pool.

For this purpose, this invention proposes a process for the production of a hydrocarbon fraction with a high octane number and a low sulfur content starting from a hydrocarbon feedstock, comprising at least the following stages:

- A stage for hydrodesulfurization of the hydrocarbon feedstock,
- At least one stage for extraction of aromatic compounds over all or part of the effluent that is obtained from the hydrodesulfurization stage, whereby said extraction leads to a paraffin-enriched raffinate and an aromatic compound-enriched extract that is sent to a gasoline pool.

In one embodiment of the invention, the hydrocarbon feedstock is obtained from a catalytic cracking unit or a thermal cracking unit or a coking unit or a visbreaking unit.

According to one embodiment of the invention, the hydrodesulfurization stage is selective and carried out in one stage in one or two reactors or in two stages.

According to another embodiment of the invention, the hydrodesulfurization stage is non-selective.

In one embodiment of the invention, a portion of the paraffinic raffinate is sent to a steam-cracking unit or to a catalytic reforming unit.

In one embodiment of the invention, a portion of the paraffinic raffinate is sent in a mixture with the aromatic extract to a gasoline pool.

In one embodiment of the invention, at least a portion of the paraffinic raffinate is sent to a separation stage that leads to a light raffinate that is sent to the gasoline pool, in a mixture with the aromatic extract, and/or to a steam-cracking unit or a catalytic reforming unit, and a heavy raffinate that is sent to the diesel pool or to the kerosene pool.

According to one embodiment of the invention, the process comprises the following stages:

- A selective hydrogenation stage of the diolefins of the hydrocarbon feedstock,
- A stage for separation of the effluent that is obtained in the selective hydrogenation stage leading to at least two fractions, a light hydrocarbon fraction and a heavy hydrocarbon fraction that is sent as a feedstock from the hydrodesulfurization stage.

According to another embodiment of the invention, the following stages:

- A selective hydrogenation stage of the diolefins of the hydrocarbon feedstock,
- A stage for separating the effluent that is obtained in the selective hydrogenation stage leading to at least two fractions, a light hydrocarbon fraction and an intermediate hydrocarbon fraction sent as a feedstock from the hydrodesulfurization stage.

In one embodiment of the invention, the light hydrocarbon fraction is sent in a mixture with the aromatic extract, and a portion of the paraffinic raffinate to the gasoline pool.

In one embodiment of the invention, the stage for extracting aromatic compounds is a liquid-liquid extraction or an extractive distillation.

In one embodiment of the invention, the stage for extraction of the aromatic compounds is a liquid-liquid extraction with a solvent ratio of between 1.5 and 5.

The invention also relates to the use of the process according to the invention for producing a hydrocarbon fraction that is low in aromatic compounds and/or olefins and that is used in petrochemistry starting from a gasoline fraction.

According to one embodiment of the invention, the hydrocarbon fraction is used in a steam-cracking process.

According to another embodiment of the invention, the hydrocarbon fraction is used in a catalytic reforming process.

Figure 2:
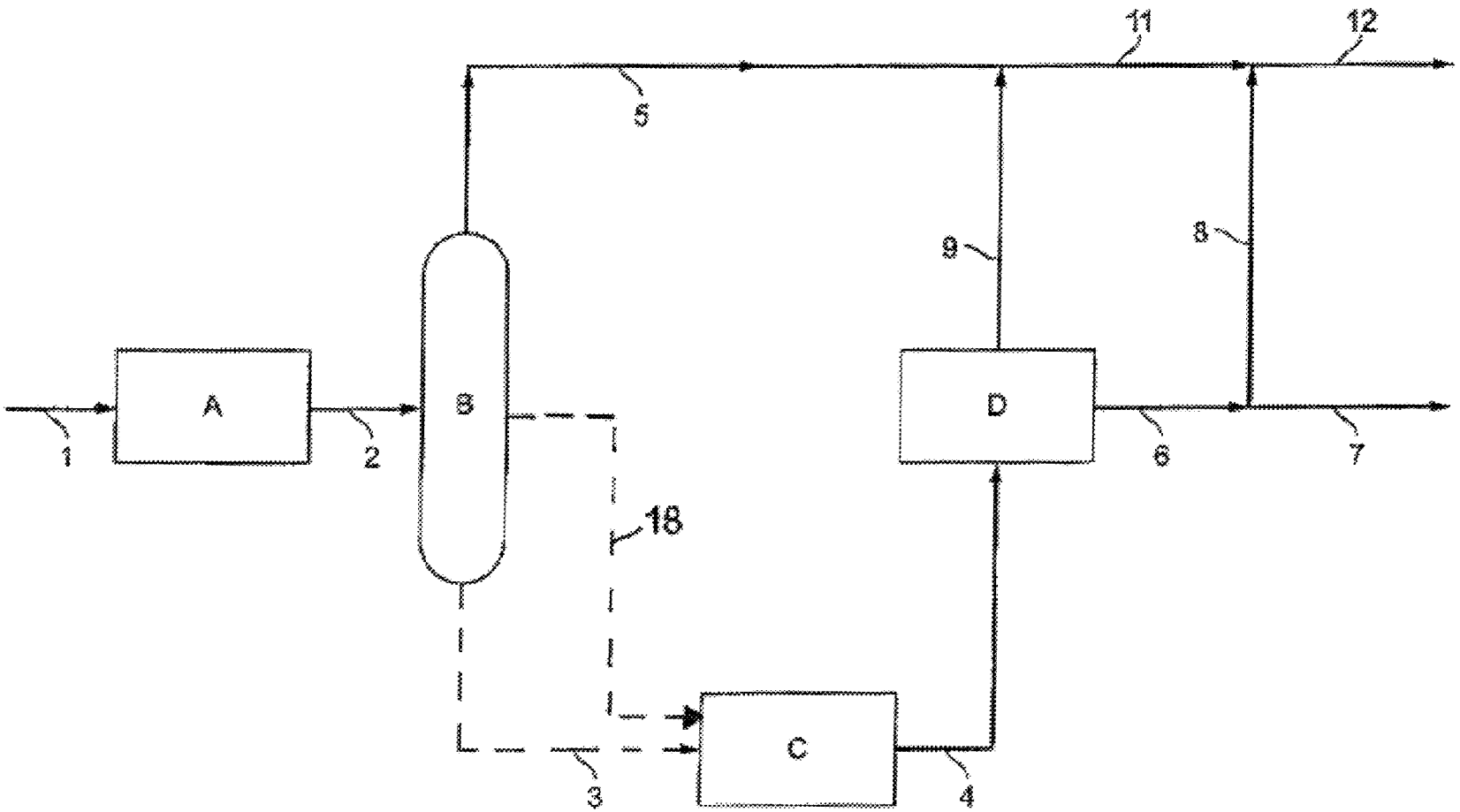
Figure 3:
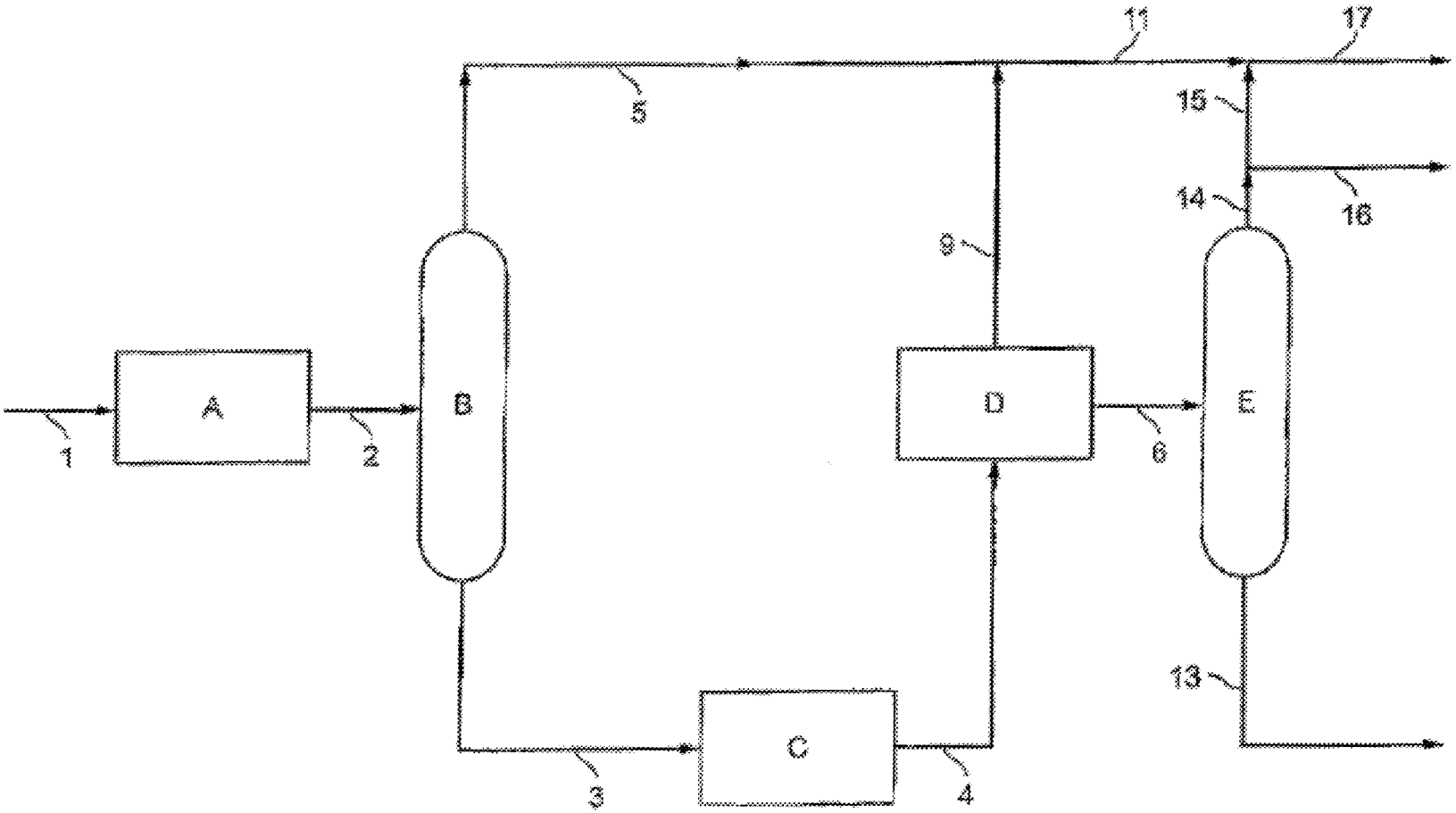

Other characteristics and advantages of the invention will be better understood and will become clearer from reading the description given below, by referring to the accompanying figures and that are provided by way of example:

FIG. 1 is a diagrammatic representation of the process for the production of a hydrocarbon fraction according to the invention, FIG. 2 is a diagrammatic representation of a variant of the process for the production of a hydrocarbon fraction according to the invention, FIG. 3 is a diagrammatic representation of another variant of the process for the production of a hydrocarbon fraction according to the invention.

The process according to the invention, illustrated in FIGS. 1, 2, and 3, consists in producing a hydrocarbon fraction with a high octane number and a low sulfur content.

The feedstock that is used in the process according to the invention is a hydrocarbon feedstock that contains sulfur and whose boiling point extends from the boiling point of the hydrocarbon feedstocks with 4 carbon atoms ($C_4$) up to the final boiling point of 300° C. according to the ASTM D86 standard. The hydrocarbon feedstock that is used in the process according to the invention can be, for example, a gasoline fraction that is obtained from a catalytic cracking unit, a thermal cracking unit (Steam Cracker according to English terminology), a coking unit (coker according to English terminology), or a visbreaking unit (visbreaker according to English terminology).

The feedstock that is used in the process according to the invention generally comprises:

An olefin fraction of more than 5% by weight and most often more than 10% by weight A fraction of aromatic compounds of more than 5% by weight and most often more than 10% by weight At least 50 ppm by weight of sulfur.

In the process according to the invention, illustrated in FIG. 1, the hydrocarbon feedstock is subjected to at least one hydrodesulfurization treatment and one extraction treatment of aromatic compounds. For this purpose, the feedstock is sent via the line (1) to a hydrodesulfurization unit (C). The effluent that is obtained from the hydrodesulfurization unit (C) circulates via the line (4) before being sent to the unit for extracting aromatic compounds (D). The aromatic extract (also called aromatic compound-enriched extract relative to the feedstock) then circulates via the line (9). The paraffinic raffinate (also called paraffin-enriched raffinate relative to the feedstock) that is obtained at the outlet of the unit for extracting aromatic compounds (D) circulates via the line (6). A portion of this paraffinic raffinate is sent via the line (7) to a steam-cracking unit. The other portion of this paraffinic raffinate is sent via the line (8) to the gasoline pool. The mixture of effluents (aromatic extract and paraffinic raffinate) that circulates in the lines (9) and (8) is sent via the line (10) to the gasoline pool.

The scheme of stages of hydrodesulfurization and extraction of the aromatic compounds makes it possible to upgrade the entire hydrocarbon feedstock and in particular a gasoline fraction by reducing the sulfur content and by maximizing the octane number of the gasoline. A portion of the gasoline can be converted into middle distillate with a low sulfur content. Another portion of the gasoline can be used in a base for the petrochemistry by being sent to a steam-cracking unit.

The process according to the invention thus makes it possible to meet the above-cited constraints by reducing the amount of gasoline produced from a hydrocarbon feedstock in favor of a better raffinate for the petrochemistry.

According to a variant of the process according to the invention (illustrated in FIG. 2), the stages of hydrodesulfurization and extraction of the aromatic compounds can be preceded by a selective hydrogenation stage, itself followed by a separation stage. In this variant, the feedstock is sent via the line (1) to a selective hydrogenation unit (A). The effluent that is obtained from the selective hydrogenation unit (A) circulates via the line (2) and then is injected into a separation column (B) that leads to at least two fractions: a light gasoline fraction that is sent to the gasoline pool via the line (5): this light fraction will have a maximum ASTM D86 final point of 160° C., preferably 120° C., and very preferably 90° C., whereby a heavy gasoline fraction circulates via the line (3), and optionally an intermediate gasoline fraction circulates via the line (18). This intermediate fraction in general has an ASTM D86 final boiling point that is less than or equal to 220° C., preferably less than or equal to 180° C., and very preferably less than or equal to 160° C. When an intermediate fraction (18) is produced, it is sent to the hydrodesulfurization unit (C) via the line (18). The heavy fraction that circulates via the line (3) is sent to the middle distillates after hydrotreatment, if necessary. In the case where there is no intermediate fraction, the heavy fraction is sent to the hydrodesulfurization unit (C) via the line (3).

The effluent that is obtained from the hydrodesulfurization unit (C) circulates via the line (4) before being sent to the unit (D) for extracting aromatic compounds. The paraffinic raffinate circulates via the line (6). A portion of this paraffinic raffinate is sent via the line (7) to a steam-cracking unit. The other portion of this paraffinic raffinate is sent via the line (8) to the gasoline pool. The effluents (light gasoline and aromatic extract) that circulate in the lines (9) and (5) are mixed via the line (11) before being sent in a mixture with the effluent (paraffinic raffinate) that circulates via the line (B) to the gasoline pool.

This variant of the process according to the invention makes it possible at the time of the separation stage to obtain a light gasoline fraction that contains less than 10 ppm of sulfur and a heavy gasoline fraction with a controlled olefin content, which involves a reduction of 15 to 85% of the olefins that are sent into the hydrodesulfurization unit.

In the case where it is desirable to maximize the feedstock in the steam-cracking device, the proposed configuration can consist in:

A selective hydrogenation stage,

A separation stage,

A stage for hydrodesulfurization on the heavy gasoline fraction and a portion of the light gasoline fraction, A stage for extracting aromatic compounds over all of the effluent obtained from the hydrodesulfurization unit, Sending all of the paraffinic raffinate that is obtained to the steam-cracking device.

It is also possible to separate the paraffinic raffinate into two fractions, one light fraction that is low in sulfur and in octane that is sent to the gasoline pool if a margin is used in terms of octane number or, in the contrary case, in the steam-cracking device and a heavy fraction that is low in sulfur and controlled flash point that is sent to the kerosene pool or to the diesel pool.

According to another variant of the process according to the invention (illustrated in FIG. 3), the extraction stage of the aromatic compounds can be followed by a separation stage. The feedstock is sent via the line (1) to the selective hydrogenation unit (A). The effluent that is obtained from the selective hydrogenation unit (A) circulates via the line (2) and then is injected into a separation column (B) that leads to two fractions: a light gasoline fraction that is sent to the gasoline pool via the line 5 and a heavy gasoline fraction that is sent to the hydrodesulfurization unit (C) via the line (3). The effluent that is obtained from the hydrodesulfurization unit (C) circulates via the line (4) before being sent to the unit (D) for extracting aromatic compounds.

The paraffinic raffinate circulates via the line (6). The effluents (light gasoline and aromatic extract) that circulate in the lines (9) and (5) are mixed via the line (11).

The paraffinic raffinate that circulates via the line (6) is sent to a separation column (E). The heavy raffinate is sent to the diesel fraction via the line (13). The light raffinate circulates via the line (14). A portion of this light raffinate is sent via the line (15) to the gasoline pool, and the other portion is sent via the line (16) to the steam-cracking device. The effluent that circulates via the line (11) is mixed with the effluent that circulates via the line (15) to provide the effluent that circulates via the line (17) that is sent to the gasoline pool.

This variant can be used in the case where it is desirable to maximize the production of distillates, without sending product to petrochemistry.

According to another variant of the process according to the invention (not illustrated), the hydrocarbon feedstock, without any prior selective hydrogenation stage or separation, is subjected to at least one hydrodesulfurization treatment and a treatment for extracting aromatic compounds that can be followed by a separation stage. For this purpose, the feedstock is sent to a hydrodesulfurization unit. The effluent that is obtained from the hydrodesulfurization unit is sent to the unit for extracting aromatic compounds. The paraffinic raffinate that is obtained at the outlet of the unit for extracting aromatic compounds is sent to a separation column. The heavy raffinate is sent to the diesel fraction. A portion of the light raffinate is sent to the gasoline pool, and the other portion is sent to the steam-cracking device. The aromatic extract that is obtained from the extraction unit is mixed with the other portion of the light raffinate to then be sent to the gasoline pool.

The various stages of the process according to the invention are described in more detail below.

Selective Hydrogenation Stage

The process according to the invention can comprise a selective hydrogenation stage. This stage has as its object to transform the diolefins, present in the hydrocarbon feedstock, into olefins. During this stage, it is also possible to increase the weight of the light sulfur products that are present in the hydrocarbon feedstock.

This selective hydrogenation stage takes place in a reactor that is generally in the presence of a catalyst that contains at least one metal from group VIII, preferably selected from the group that is formed by platinum, palladium and nickel, and a substrate. It is possible, for example, to use a nickel- or palladium-based catalyst deposited on an inert substrate, such as, for example, alumina, silica or a substrate that contains at least 50% alumina.

Another metal can be combined with the primary metal to form a bimetallic catalyst, such as, for example, molybdenum or tungsten. The use of such catalytic formulas has been claimed in, for example, the patent FR 2 764 299.

The selection of the operating conditions is particularly important. In general, the stage is carried out under pressure and in the presence of an amount of hydrogen that slightly exceeds the stoichiometric value that is necessary for hydrogenating the diolefins. The hydrogen and the feedstock that are to be treated are injected into upward or downward currents in a reactor that in general comprises a fixed catalyst bed.

The pressure that is employed during the selective hydrogenation reaction should be adequate to keep more than 60% by weight of the feedstock to be treated in the liquid phase in the reactor, preferably more than 80%, and more preferably more than 95%. The pressure is thus generally between, for example, 0.4 and 5 MPa, preferably more than 1 MPa, and more preferably between 1 and 4 MPa. The hourly volumetric flow rate of the feedstock to be treated is between about 1 and about 20 $h^{-1}$ (volume of feedstock per volume of catalyst and per hour), preferably between 2 and 10 $h^{-1}$, and very preferably between 2 and 8 $h^{-1}$.

The temperature is most generally between about 50° C. and about 250° C., and preferably between 80° C. and 220° C., and more preferably between 100° C. and 200° C., to ensure an adequate conversion of the diolefins.

The hydrogen to feedstock ratio that is expressed in terms of liters is generally between 3 and 50 liters per liter, preferably between 3 and 20 liters per liter.

In the case of the treatment of a catalytic cracking gasoline, the latter can contain up to several % by weight of diolefins (from 0.1% to 5%). After hydrogenation, the diolefin content is generally reduced to less than 3,000 rpm, and preferably to less than 1,500 ppm.

So as to transform the light sulfur compounds into heavy sulfur compounds, this hydrogenation stage can be carried out by passing, for example, the initial carbon feedstock to a catalyst that is able both to hydrogenate the diolefins and to transform the light sulfur compounds or the olefins into heavier sulfur compounds, or on a separate catalyst (identical or different), but making it possible to carry out this transformation in the same reactor as the hydrogenation stage.

Stage for Separation of the Effluent that is Obtained from the Hydrogenation Stage The process according to the invention generally can comprise a stage for separation of the effluent that is obtained in the hydrogenation stage into at least two fractions. These fractions are:

A light fraction that contains a limited residual sulfur content and that contains the olefins that can be used as a feedstock of the petrochemistry or incorporated into the gasoline pool without other downstream treatment whose purpose is to reduce its sulfur content, A heavy fraction that is enriched with aromatic compounds relative to the feedstock and in which the major portion of the sulfur compounds, initially present in the feedstock, is concentrated, Optionally, an intermediate fraction that contains the major portion of the BTX (benzene, toluene, and xylene) products that are initially present in the feedstock.

This separation stage is carried out preferably by means of a standard distillation/fractionation column. This fractionation column is to make it possible to separate at least the light fraction of the feedstock that is obtained from the hydrogenation that contains a small sulfur fraction and the heavy fraction containing the major portion of the sulfur that is initially present in the initial feedstock.

This column generally operates at a pressure of between 0.1 and 2 MPa and preferably between 0.1 and 1 MPa. The number of theoretical plates of this separation column is generally between 10 and 100 and preferably between 20 and 60. The reflux rate, which is expressed as being the ratio of liquid traffic in the column divided by the flow of distillate, expressed in kg/h, is generally between 0.1 and 2, preferably more than 0.5.

The light gasoline that is obtained at the end of the separation generally contains at least 50% of the C5 olefins, and preferably at least 90%, optionally of C5 compounds, C6 olefins and $C_7$ compounds.

Generally, this light fraction has a low sulfur content, i.e., it is not in general necessary to treat the light fraction before using it as fuel.

However, in certain extreme cases, a softening of the light gasoline can be considered.

Hydrodesulfurization Stage

The process according to the invention comprises a hydrodesulfurization stage. This stage can be carried out either directly on the initial feedstock, or on the heavy fraction that is obtained at the end of the separation stage.

The hydrodesulfurization that is carried out within the framework of the process can be selective (with a controlled olefin saturation rate, i.e., the preservation of a portion of the olefins) or non-selective (saturation of olefins). This stage is generally carried out in at least one reactor in the presence of catalyst that comprises at least one element from the group VIII.

Selective Hydrodesulfurization:

The selective hydrodesulfurization can be carried out either in one stage or in two stages.

By two stages, we designate the diagrams with intermediate elimination of $H_2S$.

In the case of a diagram with one stage, this stage can contain one or two reactors with different operating conditions.

Case of a Single Reactor:

The catalyst that is used is generally a catalyst that comprises cobalt or nickel and molybdenum. This stage is carried out in the presence of hydrogen, at a temperature of between, for example, 200° C. and 400° C., preferably between 220° C. and 350° C. under a pressure that is generally between 0.5 and 5 MPa, preferably between 1 and 3 MPa, and very preferably between 1.5 and 3 MPa. The liquid volumetric flow rate is between, for example, 0.5 and about 10 $h^{-1}$ (expressed in terms of liquid volume per volume of catalyst and per hour), and preferably between 1 and 8 $h^{-1}$. The $H_2$/HC ratio is adjusted based on the desired hydrodesulfurization rates in the range of between, for example, 100 and 600 liters per liter and preferably between 100 and 350 liters per liter.

Case of Two Reactors:

The catalyst and the operating conditions that are used in the first reactor are similar to the ones that are described in the case of a single reactor.

In the second reactor, the catalysts that are used are generally catalysts that comprise cobalt and molybdenum or catalysts that comprise nickel.

The temperature in the $2^{nd}$ reactor is generally between 250 and 400° C. and preferably between 300 and 370° C. The liquid volumetric flow rate is between, for example, 0.5 and about 10 $h^{-1}$ (expressed in terms of liquid volume per volume of catalyst and per hour), and preferably between 1 and 8 $h^{-1}$.

The conditions of pressure and the $H_2$/HC ratio are similar to those of the first reactor in the first stage.

This configuration (and in particular the decoupling of the temperatures and the use of concatenation of the catalyst) makes it possible to be more selective than in the configuration with 1 single reactor. The preservation of the olefins through the HDS stage is therefore better.

In the case of two stages, the latter are:

- A first stage: operated under conditions of pressure, temperature, LHSV and $H_2$/HC, similar to the one of a 1-stage scheme with 1 reactor
- A second stage: treats the effluent from the $1^{st}$ stage after elimination of $H_2S$, operated under conditions that are within the same ranges as that of the $1^{st}$ stage.

The catalyst that is used is generally a catalyst that comprises cobalt and molybdenum in 2 stages.

This configuration makes it possible to be even more selective using the intermediate elimination of $H_2S$ between the two stages, which reduces the $H_2S$ partial pressure.

In the case of the selective hydrodesulfurization, the conversion of the olefins by observed hydrodesulfurization is 5 to 95%, preferably 15 to 85%, and very preferably 15 to 50%.

Non-Selective Hydrodesulfurization:

This stage is carried out in the presence of hydrogen, at a temperature of between, for example, 200° C. and 400° C., preferably between 220° C. and 350° C. under a pressure generally of between 0.5 and 5 MPa, preferably between 1 and 3 MPa, and very preferably between 1.5 and 3 MPa. The liquid volumetric flow rate is between, for example, 0.5 and about 10 $h^{-1}$ (expressed in terms of liquid volume per volume of catalyst and per hour) and preferably between 1 and 8 $h^{-1}$. The $H_2$/HC ratio is adjusted based on the desired hydrodesulfurization rates within the range of between, for example, 100 and 600 liters per liter, and preferably between 100 and 350 liters per liter.

The primary difference relative to a selective hydrodesulfurization is the selection of the catalyst. The catalyst that is used is generally a catalyst that comprises cobalt and molybdenum or nickel and molybdenum. The catalysts that are used have a stronger hydrogenating activity than in the case of a selective hydrodesulfurization.

In the process according to the invention, the conversion of the unsaturated sulfur compounds is more than 15% and preferably more than 90%.

In the case of the non-selective hydrodesulfurization, the reduction of the olefins that is observed is more than 50%, preferably more than 85%, and very preferably more than 95%.

Extraction Stage of the Aromatic Compounds:

The process according to the invention comprises an extraction stage of the aromatic compounds. This extraction is either a liquid-liquid extraction or an extractive distillation that employs one or more solvents.

In the case of a standard liquid-liquid extraction, the extraction is carried out by means of any type of solvent that is well known to one skilled in the art for carrying out such extractions and, for example, sulfolane-type solvents, dimethyl sulfoxide (DMSO), dimethylformamide (DMF), N-methylpyrrolidone (NMP), N-formylmorpholine (NFM), methanol, acetonitrile and mixtures of these different solvents. The effluent that is obtained after the hydrodesulfurization stage is brought into contact with the solvent in a first extraction column from which are recovered a solvent that is rich in aromatic compounds and a raffinate that consists of non-aromatic compounds. The raffinate is purified below in a washing column for removing residual traces of solvent therefrom. The solvent that is rich in aromatic compounds is conventionally first rid of the last non-aromatic compounds in a separation column, then sent into a column for recovery of aromatic compounds. The solvent is recycled after regeneration, whereas the aromatic compounds are recovered in extract form.

In the case of an extractive distillation, a non-volatile separation solvent that is miscible at a high boiling point is used to modify the relative volatility (vapor pressure) of the components of a mixture whose volatility is very close. The solvent interacts differently with the various components of the mixture, thus causing a difference in volatility relative to each component and making it possible to separate them. The technique consists in sending the flow that comprises the aromatic compounds with a solvent into an extractive distillation column. The non-aromatic compounds are evacuated via the top of the column with a small amount of solvent (which is then regenerated). The aromatic compounds are evacuated via the bottom of the column with the solvent. The solvent/aromatic compound unit is sent to a separation column or the purified aromatic compounds will be separated from the solvent. The solvent that is used is well known to one skilled in the art, such as, for example, N-formyl morpholine.

One of the advantages of the invention arises from the fact that it is necessary to have neither an excellent yield nor a very high purity at the end of the extraction stage of the aromatic compounds contrary to the conditions for application of these technologies in a petrochemical environment to produce aromatic compounds with high purity and high yield. Even if the octane number is better with a higher solvent ratio, the quality of the products is acceptable with a lower solvent ratio than the one that is conventionally used by one skilled in the art. It is therefore possible to use a simplified unit for extracting aromatic compounds relative to a conventional extraction unit. In this case, preferably:

- The separation column is eliminated or else it comprises fewer plates,
- The solvent/feedstock ratio is between 1 and 10, preferably between 1 and 6, and very preferably between 1 and 3.5, contrary to a conventional extraction where the ratio is between 3 and 10.

The aromatic extract that is obtained makes it possible to remove the molecules with a low octane number that are present in the feedstock and thus generally contributes to exceeding the required specifications of a Research Octane Number (or RON, according to English terminology) of 95 and a Motor Octane Number (or MON, according to English terminology) of 85 of the gasoline pool after remixing with the other typical components (reformate, isomerate, ethers, . . . ).

The paraffinic raffinate that is obtained generally constitutes an excellent feedstock for a unit of steam-cracking or catalytic reforming and thus replaces the very expensive naphtha.

Stage for Separation of the Raffinate that is Obtained after Extraction of the Aromatic Compounds The process according to the invention can comprise a stage for separating the raffinate, obtained in the stage for extracting aromatic compounds, into at least two fractions, a light fraction that can be sent to the gasoline pool or to petrochemistry, and a heavy fraction that can be sent to the kerosene pool or diesel.

This separation is carried out preferably by means of a conventional distillation column.

This column generally operates at a pressure of between 0.01 and 2 MPa and preferably between 0.01 and 0.5 MPa. The number of theoretical plates of this separation column is generally between 10 and 100 and preferably between 20 and 60. The reflux rate, expressed as being the ratio of the liquid traffic in the column divided by the distillate flow rate expressed in kg/h, is generally more than 0.2 and preferably more than 0.4.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

The following comparative examples illustrate this invention.

EXAMPLES

Example 1

FIG. 1 a) Obtaining a Desulfurized Catalytic Cracking Gasoline

The starting material is a catalytic cracking gasoline so as to produce a quality gasoline that is at least similar to the feedstock and a raffinate that can supply a steam-cracking unit.

The catalytic cracking gasoline has the following characteristics:

| | |
|---|---|
| ASTM D86 distillation: | Starting point: 35° C.<br>Final point: 220° C. |
| Olefin content: | 33.6% by weight |
| Aromatic compound content: | 34.6% by weight |
| RON = 93.00 | |
| Sulfur = 3,278 ppm | |

The initial feedstock (1) is desulfurized selectively on a cobalt/molybdenum catalyst (HR 806 type) under the following conditions: temperature: 260° C.; P=2 MPa, VVH=4 $h^{-1}$ with an $H_2$/HC ratio of 200 l/l in the hydrodesulfurization unit (C).

b) Extraction of Desulfurized Gasoline

The effluent that is obtained in the hydrodesulfurization stage is sent via the line (4) to a unit (D) for extracting sulfolane aromatic compounds.

The unit is simplified relative to a conventional extraction unit:

The separation column is eliminated,

The solvent/feedstock ratio is reduced to 2.7.

The paraffinic raffinate that circulates via the line (6) is sent partially to the gasoline pool via the line (8) until a gasoline with octane that is greater than or equal to the feedstock is obtained.

The excess is sent to the steam-cracking device via the line (7).

c) Quality of the Products

| Effluent | 1 | 4 | 9 | 6 | 8 | 7 | 10 |
|---|---|---|---|---|---|---|---|
| Olefins % by Weight | 33.60 | 16.80 | 12.50 | 17.78 | 17.78 | 17.78 | 14.33 |
| Aromatic Compounds % by Weight | 34.60 | 34.60 | 61.00 | 28.61 | 28.61 | 28.61 | 49.80 |
| Saturated Compounds % by Weight | 31.80 | 48.60 | 26.50 | 53.62 | 53.61 | 53.61 | 35.90 |
| RON | 93.00 | 85.90 | 98.40 | 83.00 | 83.00 | 83.00 | 93.10 |
| MON | 81.60 | 80.30 | 87.00 | 78.80 | 78.80 | 78.80 | 84.18 |
| Sulfur (ppm) | 3,278.0 | 7.0 | 11.3 | 6.0 | 6.0 | 6.0 | 9.5 |
| Flow Rate (kg/h) | 100,000 | 100,000 | 18,500 | 81,500 | 9,780 | 71,720 | 28,280 |
| Density | 0.761 | 0.761 | 0.757 | 0.762 | 0.762 | 0.762 | 0.758 |

Under these conditions, a gasoline is obtained whose octane number is slightly increased (RON: 93.10) relative to the one of the initial feedstock (RON: 93.00). The sulfur content is very low (9.5 ppm) and has very greatly decreased relative to the one of the initial feedstock (3,278 ppm). The raffinate constitutes a good steam-cracking feedstock.

Example 2

FIG. 2—Selective Mode a) Obtaining a Desulfurized Catalytic Cracking Gasoline The starting material is a catalytic cracking gasoline on which it is desired to recover a raffinate for sending to the steam cracking while improving the quality of the gasoline that is produced.

The catalytic cracking gasoline that circulates via the line (1) has the following characteristics:

| | |
|---|---|
| ASTM D86 distillation: | Starting point: 35° C.<br>Final point: 140° C. |
| Olefin content: | 34.5% by weight |
| Aromatic compound content: | 19.2% by weight |
| RON = 91.40 | |
| Sulfur = 1,112 ppm | |

It is treated on a nickel-molybdenum selective hydrogenation catalyst (HR 845).

The gasoline is treated under the following conditions:

Temperature: 160° C.; pressure: 2 MPa; VVH=4 $h^{-1}$ with an $H_2$/HC ratio of 5 l/l.

The effluent that circulates via the line (2) is then fractionated on a column (stage B).

At the top, a fraction with a final desulfurized ASTM D86 boiling point of 60° C. that circulates via the line (5) is recovered. At the bottom, the ASTM D86 distillation interval fraction 60-140° C. (3) that circulates via the line (3) is desulfurized selectively on a CoMo (HR 806) catalyst under the following conditions: Temperature: 260° C.; P=2 MPa, VVH=4 $h^{-1}$ with an $H_2$/HC ratio of 200 l/l.

b) Extraction of the Desulfurized Gasoline

The effluent from hydrodesulfurization that circulates via the line (4) is sent to an extraction of a sulfolane aromatic compound.

The unit is simplified relative to a conventional extraction unit:

The separation column is eliminated,

The solvent/feedstock ratio is reduced to 2.7.

The raffinate that circulates via the line (6) is sent in part to the gasoline pool via the line (8) until a gasoline with an octane that is greater than or equal to the feedstock is obtained. The excess is sent to the steam-cracking device via the line (7). The extract (9) is sent to the gasoline pool.

c) Quality of Products

| Effluent | 1 | 5 | 3 | 4 | 9 | 6 | 8 | 7 | 12 |
|---|---|---|---|---|---|---|---|---|---|
| Olefins % by Weight | 34.50 | 46.40 | 28.09 | 14.05 | 9.30 | 15.28 | 15.28 | 15.28 | 31.74 |
| Aromatic Compounds % by Weight | 19.2 | 0.9 | 29.1 | 29.1 | 60.0 | 21.0 | 21.0 | 21.0 | 18.1 |
| Saturated Compounds % by Weight | 46.3 | 52.7 | 42.9 | 56.9 | 30.7 | 63.7 | 63.7 | 63.7 | 50.2 |

-continued

| Effluent | 1 | 5 | 3 | 4 | 9 | 6 | 8 | 7 | 12 |
|---|---|---|---|---|---|---|---|---|---|
| RON | 91.40 | 94.40 | 89.60 | 83.90 | 95.90 | 81.00 | 81.00 | 81.00 | 92.00 |
| MON | 81.00 | 83.50 | 79.50 | 77.60 | 83.50 | 76.20 | 76.20 | 76.20 | 82.00 |
| Sulfur (ppm) | 1,112.0 | 9.0 | 1,705.0 | 9.0 | 13.1 | 7.9 | 7.9 | 7.9 | 9.7 |
| Flow Rate (kg/h) | 100,000 | 35,000 | 65,000 | 65,000 | 13,390 | 51,610 | 12,902.5 | 38,707.5 | 61,293 |
| Density | 0.74 | .68 | 0.78 | 0.78 | 0.82 | 0.76 | 0.76 | 0.76 | 0.73 |

Under these conditions, a gasoline is obtained whose octane number is slightly increased (RON: 92.00) relative to that of the initial feedstock (RON: 91.40). The sulfur content is very low (<10 ppm) and has very greatly decreased relative to that of the initial feedstock (1,112 ppm). The raffinate constitutes a good steam-cracking feedstock.

Example 3

FIG. 2—Non-Selective Mode a) Obtaining a Desulfurized Catalytic Cracking Gasoline The starting material is a catalytic cracking gasoline on which it is desired to recover a raffinate for sending to the steam cracking while improving the quality of the gasoline that is produced.

The catalytic cracking gasoline that circulates via the line (1) has the following characteristics:

| | |
|---|---|
| ASTM D86 distillation: | Starting Point: 35° C. |
| | Final point: 140° C. |
| Olefin content: | 34.5% by weight |
| Aromatic content: | 19.2% by weight |
| RON = 91.40 | |
| Sulfur = 1,112 ppm | |

It is treated on a nickel-molybdenum selective hydrogenation catalyst (HR 845).

The gasoline is treated under the following conditions:

Temperature: 160° C.; pressure: 2 MPa; VVH=4 $h^{-1}$ with an $H_2$/HC ratio of 5 l/l.

The effluent (2) is then fractionated (unit B). At the top, a fraction with a final desulfurized ASTM D86 boiling point of 60° C. that circulates via the line (5) is recovered. At the bottom, the ASTM D86 distillation interval fraction 60-140° C. that circulates via the line (3) is desulfurized (unit C) and hydrogenated totally on a CoMo catalyst under the following conditions: Temperature: 260° C.; P=2 MPa, VVH=4 $h^{-1}$ with an $H_2$/HC ratio of 200 l/l.

The olefins of the heavy catalytic cracking gasoline have been virtually totally hydrogenated.

b) Extraction of the Desulfurized Gasoline

The effluent from hydrodesulfurization that circulates via the line (4) is sent to an extraction of a sulfolane aromatic compound.

The unit is simplified relative to a conventional extraction unit:

The separation column is eliminated,

The solvent/feedstock ratio is reduced between 2 and 3. It is set here at 2.5.

The raffinate that circulates via the line (6) is sent in part to the gasoline pool via the line (8) until a gasoline with an octane that is greater than or equal to the feedstock is obtained. The excess is sent to the steam-cracking device via the line (7). The extract (9) is sent to the gasoline pool.

c) Quality of Products

| | | | | | | | | | |
|---|---|---|---|---|---|---|---|---|---|
| RON | 91.40 | 94.40 | 89.60 | 78.20 | 96.50 | 73.90 | 73.90 | 73.90 | 91.40 |
| MON | 81.00 | 83.50 | 79.50 | 75.70 | 84.00 | 73.70 | 73.70 | 73.70 | 82.00 |

Under these conditions, a gasoline is obtained with the same octane number as the feedstock (RON: 91.4). The sulfur content is very low (<10 ppm) and has very greatly decreased relative to that of the initial feedstock (1,112 ppm).

The raffinate constitutes a good steam-cracking feedstock that is even better than in the preceding example because it contains fewer olefins.

Example 4

FIG. 2—Non-Selective Mode a) Obtaining a Desulfurized Catalytic Cracking Gasoline The starting material is a catalytic cracking gasoline on which it is desired to recover a gasoline with a maximum octane number and a raffinate of very good quality for sending to the steam-cracking device while improving the quality of the gasoline that is produced.

The catalytic cracking gasoline has the following characteristics:

| | |
|---|---|
| ASTM D86 distillation: | Starting point: 35° C. |
| | Final point: 140° C. |
| Olefin content: | 34.5% by weight |
| Aromatic compound content: | 19.2% by weight |
| RON = 91.40 | |
| Sulfur = 1,112 ppm | |

It is treated on a nickel-molybdenum selective hydrogenation catalyst (HR 845) under the following operating conditions:

Temperature: 160° C.; pressure: 2 MPa; VVH=4 $h^{-1}$ with an $H_2$/HC ratio of 5 l/l.

The effluent (2) is then fractionated (unit B). At the top, a fraction with a final desulfurized ASTM D86 boiling point of 60° C. that circulates via the line (5) is recovered. At the bottom, the ASTM D86 distillation interval fraction 60-140° C. that circulates via the line (3) is desulfurized (unit C) and hydrogenated totally on a CoMo catalyst under the following conditions: Temperature: 260° C.; P=2 MPa, VVH=4 $h^{-1}$ with an $H_2$/HC ratio of 200 l/l.

The olefins of the heavy catalytic cracking gasoline have been virtually totally hydrogenated.

b) Extraction of the Desulfurized Gasoline

The effluent from hydrodesulfurization that circulates via the line (4) is sent to an extraction of a sulfolane aromatic compound (unit D).

The unit is identical to the conventional aromatic extraction units. The solvent/feedstock ratio is 6.

The raffinate (7) is sent to steam-cracking. Because of its virtually totally paraffinic nature, it constitutes an excellent steam-cracking feedstock.

The extract (9) is sent to the gasoline pool.

The gasoline that is produced has an octane number that is very greatly improved relative to the feedstock.

c) Quality of the Products

| Effluent | 1 | 5 | 3 | 4 | 9 | 7 | 12 |
|---|---|---|---|---|---|---|---|
| Olefins % by Weight | 34.5 | 46.4 | 28.1 | 2.8 | 1.3 | 3.37 | 31.3 |
| Aromatic Compounds % by Weight | 19.2 | 0.9 | 29.0 | 29.0 | 85.2 | 8.12 | 29.2 |
| Saturated Compounds % by Weight | 46.3 | 52.7 | 42.8 | 68.1 | 13.5 | 88.51 | 39.6 |
| RON | 91.40 | 94.40 | 89.60 | 78.20 | 102.80 | 69.70 | 96.90 |
| MON | 81.00 | 83.50 | 79.50 | 75.70 | 91.80 | 70.10 | 85.90 |
| Sulfur (ppm) | 1,112 | 10 | 1,705 | 10 | 11 | 10 | 10 |
| Flow Rate (kg/h) | 100,000 | 35,000 | 65,000 | 65,000 | 17,654 | 47,346 | 52,654 |
| Density | 0.74 | 0.682 | 0.776 | 0.776 | 0.823 | 0.760 | 0.723 |

Under these conditions, a gasoline is obtained whose octane number (RON: 96.90) is greater relative to the one of the initial feedstock (RON: 91.40). The sulfur content is very low (<10 ppm) and has very greatly decreased relative to the one of the initial feedstock (1,112 ppm).

Example 5

FIG. 3 a) Obtaining a Desulfurized Catalytic Cracking Gasoline

The starting material is a catalytic cracking gasoline on which it is desired to send 20% to the diesel pool while producing a gasoline of a quality that is at least similar to the feedstock and by producing a raffinate that can supply a steam-cracking device.

The catalytic cracking gasoline has the following characteristics:

| | |
|---|---|
| ASTM D86 distillation: | Starting point: 35° C.<br>Final point: 220° C. |
| Olefin content: | 33.6% by weight |
| Aromatic compound content: | 34.6% by weight |
| RON = 93.00 | |
| Sulfur = 3,278 ppm | |

It is treated on a nickel-molybdenum selective hydrogenation catalyst (HR 845 type) under the following operating conditions:

Temperature: 160° C.; Pressure=2 MPa, VVH=4 $h^{-1}$ with an $H_2$/HC ratio of 5 l/l.

The effluent that is obtained at the end of the selective hydrogenation that circulates via line (2) is then fractionated on a fractionation column (B). At the top of the column, a fraction with a final desulfurized ASTM D86 boiling point of 60° C. that circulates via the line (5) is recovered.

At the bottom, the fraction with an ASTM D86 distillation interval 60-220° C. that circulates via the line (3) is selectively desulfurized (unit C) on a cobalt/molybdenum catalyst (HR 806 type) under the following operating conditions: Temperature: 260° C.; P=2 MPa, VVH=4 $h^{-1}$ with an $H_2$/HC ratio of 200 l/l.

b) Extraction of the Desulfurized Gasoline

The effluent from the hydrodesulfurization stage (4) is sent to an extraction of a sulfolane aromatic compound. The unit is simplified relative to a conventional extraction unit:

The solvent/feedstock ratio is reduced to 3.5.

The extraction raffinate that circulates via the line (6) is then distilled. The heaviest desulfurized fraction (with an ASTM D86 distillation interval of 150-220° C.) is sent to the diesel pool via the line (13).

The light raffinate (having a final ASTM D86 distillation point of 150° C.) that circulates via the line (14) is sent partially to the gasoline pool (15) until a gasoline with an octane that is greater than or equal to the feedstock is obtained.

The excess is sent to the steam-cracking device (16).

c) Quality of Products

| Effluent | 1 | 5 | 3 | 4 | 9 | 6 | 14 | 13 | 15 | 16 | 17 |
|---|---|---|---|---|---|---|---|---|---|---|---|
| Olefins % by Weight | 33.6 | 61.6 | 26.6 | 13.3 | 8.3 | 14.8 | 18.1 | 8.0 | 18.1 | 18.1 | 32.1 |
| Aromatic Compounds % by Weight | 34.6 | 0.0 | 43.3 | 43.3 | 82.9 | 31.1 | 12.9 | 68.9 | 12.9 | 12.9 | 34.4 |
| Saturated Compounds % by Weight | 31.8 | 38.4 | 30.2 | 43.5 | 8.8 | 54.1 | 69.0 | 23.1 | 69.0 | 69.0 | 33.5 |
| RON | 93.00 | 95.00 | 92.40 | 87.00 | 103.40 | 81.80 | 83.00 | 79.10 | 83.00 | 83.00 | 95.70 |
| MON | 81.60 | 83.20 | 81.10 | 79.30 | 92.00 | 75.30 | 75.00 | 76.00 | 75.00 | 75.00 | 84.80 |
| Sulfur (ppm) | 3,278 | 8 | 4,096 | 8 | 10 | 7 | 11 | <10 | 11 | 11 | 9 |
| Flow Rate (kg/h) | 100,000 | 20,000 | 80,000 | 80,000 | 18,800 | 61.200 | 41,347 | 19,853 | 10,337 | 31,010 | 49,137 |
| Density | 0.76 | 0.66 | 0.79 | 0.79 | 0.77 | 0.79 | 0.77 | 0.85 | 0.77 | 0.77 | 0.72 |

Under these conditions, a gasoline is obtained whose octane number is increased (RON: 95.70) relative to that of the initial feedstock (RON: 93.00). The sulfur content is very low (<10 ppm) and has very greatly decreased relative to that of the initial feedstock (3,278 ppm).

The fraction with an ASTM D86 150-220 distillation interval will be sent to the diesel pool or kerosene pool with, if necessary, a preceding hydrotreatment.

The light raffinate constitutes a good steam-cracking feedstock.

The set of the examples, illustrating the different variants of the invention, demonstrates the fact that the process according to the invention makes it possible to preserve and, in some cases, to increase the octane number of the hydrocarbon feedstock that is obtained, while very significantly reducing its sulfur content.

The amount of gasoline is also very greatly reduced on behalf of a better raffinate for the petrochemistry.

It should be obvious to one skilled in the art that this invention should not be limited to the details that are provided above and makes embodiments possible under numerous other specific forms without moving away from the field of application of the invention. Consequently, these embodiments should be considered by way of illustration and can be modified without, however, going beyond the scope defined by the claims.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of a hydrocarbon fraction with a high octane number and a low sulfur content from a hydrocarbon feedstock, comprising at least the following steps:

a hydrodesulfurization step of the hydrocarbon feedstock thereby providing a desulfurized effluent, at least one step for extracting aromatic compounds from all or part of resulting effluent obtained from the hydrodesulfurization step, whereby the extraction leads to a paraffin-enriched raffinate relative to the feedstock and an aromatic compound-enriched extract that is sent to a gasoline pool, and wherein the hydrodesulfurization stage is selective to preserve a portion of an olefin fraction of the hydrocarbon feedstock and carried out in one stage in one or two reactors or in two stages.

2. A process according to claim 1, in which the hydrocarbon feedstock is obtained from a catalytic cracking unit or a thermal cracking unit or a coking unit or a visbreaking unit.

3. A process according to claim 1, in which a portion of the paraffinic raffinate is sent to a steam-cracking unit to produce light olefins or to a catalytic reforming unit to produce aromatic compounds.

4. A process according to claim 1 that further comprises the following stages:

A stage for selective hydrogenation of a diolefins fraction of the hydrocarbon feedstock, A step for separating the effluent that is obtained in the selective hydrogenation stage that leads to at least two fractions, a light hydrocarbon fraction and a heavy hydrocarbon fraction, sent as a feedstock to the hydrodesulfurization stage.

5. A process according to claim 1 that further comprises the following stages:

A stage for selective hydrogenation of a diolefins fraction of the hydrocarbon feedstock, A stage for separating the effluent that is obtained in the selective hydrogenation stage that leads to at least two fractions, a light hydrocarbon fraction and an intermediate hydrocarbon fraction sent as a feedstock to the hydrodesulfurization stage.

6. A process according to claim 1, in which the aromatic extraction stage is a liquid-liquid extraction or an extractive distillation.

7. A process for the production of a hydrocarbon fraction with a high octane number and a low sulfur content from a hydrocarbon feedstock, comprising at least the following steps:

a hydrodesulfurization step of the hydrocarbon feedstock thereby providing a desulfurized effluent, at least one step for extracting aromatic compounds from all or part of resulting effluent obtained from the hydrodesulfurization step, whereby said extraction leads to a paraffin-enriched raffinate relative to the feedstock and an aromatic compound-enriched extract that is sent to a gasoline pool, and wherein a portion of the paraffin-enriched raffinate is sent in a mixture with the aromatic compound-enriched extract to a gasoline pool.

8. A process according to claim 7, in which the hydrocarbon feedstock is obtained from a catalytic cracking unit or a thermal cracking unit or a coking unit or a visbreaking unit.

9. A process according to claim 7, in which the hydrodesulfurization stage is selective and carried out in one stage in one or two reactors or in two stages.

10. A process according to claim 7, in which the hydrodesulfurization stage is non-selective.

11. A process according to claim 7, in which a portion of the paraffinic raffinate is sent to a steam-cracking unit to produce light olefins or to a catalytic reforming unit to produce aromatic compounds.

12. A process according to claim 7 that further comprises the following stages:

A stage for selective hydrogenation of a diolefins fraction of the hydrocarbon feedstock, A step for separating the effluent that is obtained in the selective hydrogenation stage that leads to at least two fractions, a light hydrocarbon fraction and a heavy hydrocarbon fraction, sent as a feedstock to the hydrodesulfurization stage.

13. A process according to claim 7 that further comprises the following stages:

A stage for selective hydrogenation of a diolefins fraction of the hydrocarbon feedstock, A stage for separating the effluent that is obtained in the selective hydrogenation stage that leads to at least two fractions, a light hydrocarbon fraction and an intermediate hydrocarbon fraction sent as a feedstock to the hydrodesulfurization stage.

14. A process according to claim 7, in which the aromatic extraction stage is a liquid-liquid extraction or an extractive distillation.

15. A process according to claim 14, in which the stage for extracting aromatic compounds is a liquid-liquid extraction with a solvent ratio of between 1.5 and 5.

16. A process according to claim 15, wherein said hydrocarbon feedstock is a gasoline fraction, and the process produces a hydrocarbon fraction low in aromatic compounds and/or olefins.

17. A process according to claim 16, wherein the hydrocarbon fraction is subjected to a steam-cracking process.

18. A process according to claim 16, wherein the hydrocarbon fraction is subjected to a catalytic reforming process.

19. A process according to claim 14, in which the stage for extracting aromatic compounds is a liquid-liquid extraction with a solvent ratio of between 1.5 and 5.

20. A process for the production of a hydrocarbon fraction with a high octane number and a low sulfur content from a hydrocarbon feedstock, comprising at least the following steps:

a hydrodesulfurization step of the hydrocarbon feedstock thereby providing a desulfurized effluent, at least one step for extracting aromatic compounds from all or part of the effluent obtained from the hydrodesulfurization step, whereby the extraction leads to a paraffin-enriched raffinate relative to the feedstock and an aromatic compound-enriched extract that is sent to a gasoline pool, and wherein at least a portion of the paraffin-enriched raffinate is sent to a separation stage that leads to a light raffinate that is sent to the gasoline pool, in a mixture with the aromatic-compound enriched extract, and/or to a steam-cracking unit or a catalytic reforming unit, and a heavy raffinate that is sent to a diesel pool or to a kerosene pool.

21. A process according to claim 20, in which the hydrocarbon feedstock is obtained from a catalytic cracking unit or a thermal cracking unit or a coking unit or a visbreaking unit.

22. A process according to claim 20, in which the hydrodesulfurization stage is selective and carried out in one stage in one or two reactors or in two stages.

23. A process according to claim 20, in which the hydrodesulfurization stage is non-selective.

24. A process according to claim 20, in which a portion of the paraffinic raffinate is sent to a steam-cracking unit to produce light olefins or to a catalytic reforming unit to produce aromatic compounds.

25. A process according to claim 20 that further comprises the following stages:

A stage for selective hydrogenation of a diolefins fraction of the hydrocarbon feedstock, A step for separating the effluent that is obtained in the selective hydrogenation stage that leads to at least two fractions, a light hydrocarbon fraction and a heavy hydrocarbon fraction, sent as a feedstock to the hydrodesulfurization stage.

26. A process according to claim 20 that further comprises the following stages:

A stage for selective hydrogenation of a diolefins fraction of the hydrocarbon feedstock, A stage for separating the effluent that is obtained in the selective hydrogenation stage that leads to at least two fractions, a light hydrocarbon fraction and an intermediate hydrocarbon fraction sent as a feedstock to the hydrodesulfurization stage.

27. A process according to claim 20, in which the aromatic extraction stage is a liquid-liquid extraction or an extractive distillation.

28. A process according to claim 27, in which the stage for extracting aromatic compounds is a liquid-liquid extraction with a solvent ratio of between 1.5 and 5.

29. A process for the production of a hydrocarbon fluid with a high octane number and a low sulfur content from a hydrocarbon feedstock, comprising at least the following steps:

a hydrodesulfurization step of the hydrocarbon feedstock thereby providing a desulfurized effluent, at least one step for extracting aromatic compounds from all or part of the effluent obtained from the hydrodesulfurization step, whereby said extraction leads to a paraffin-enriched raffinate relative to the feedstock and an aromatic compound-enriched extract that is sent to a gasoline pool, and wherein the process further comprises:

a step for selective hydrogenation of diolefins in the hydrocarbon feedstock providing a diolefin-depleted effluent, a step for separating the diolefin-depleted effluent obtained in the selective hydrogenation step into at least two fractions, a light hydrocarbon fraction and a heavy hydrocarbon fraction that is sent as a feedstock to the hydrodesulfurization step, and wherein the light hydrocarbon fraction is sent in a mixture with the aromatic extract and a portion of the paraffinic raffinate to a gasoline pool.

30. A process according to claim 29, in which the hydrocarbon feedstock is obtained from a catalytic cracking unit or a thermal cracking unit or a coking unit or a visbreaking unit.

31. A process according to claim 29, in which the hydrodesulfurization stage is selective and carried out in one stage in one or two reactors or in two stages.

32. A process according to claim 29, in which the hydrodesulfurization stage is non-selective.

33. A process according to claim 29, in which the aromatic extraction stage is a liquid-liquid extraction or an extractive distillation.

34. A process according to claim 33, in which the stage for extracting aromatic compounds is a liquid-liquid extraction with a solvent ratio of between 1.5 and 5.

* * * * *

UNITED STATES PATENT AND TRADEMARK OFFICE

CERTIFICATE OF CORRECTION

PATENT NO. : 8,246,811 B2
APPLICATION NO. : 12/471736
DATED : August 21, 2012
INVENTOR(S) : Debuisschert et al.

It is certified that error appears in the above-identified patent and that said Letters Patent is hereby corrected as shown below:

Column 18, line 38 reads "A stage for selective hydrogenation of a diolefins fraction" should read -- A stage for selective hydrogenation of a diolefin fraction --

Column 19, line 25 reads "A stage for selective hydrogenation of a diolefins fraction" should read -- A stage for selective hydrogenation of a diolefin fraction --

Column 19, line 35 reads "A stage for selective hydrogenation of a diolefins fraction" should read -- A stage for selective hydrogenation of a diolefin fraction --

Column 20, line 31 reads "A stage for selective hydrogenation of a diolefins fraction" should read -- A stage for selective hydrogenation of a diolefin fraction --

Column 20, line 41 reads "A stage for selective hydrogenation of a diolefins fraction" should read -- A stage for selective hydrogenation of a diolefin fraction --

Signed and Sealed this
Thirteenth Day of November, 2012

David J. Kappos

David J. Kappos
*Director of the United States Patent and Trademark Office*